US005108338A

United States Patent [19]

Margolis

[11] Patent Number: 5,108,338

[45] Date of Patent: Apr. 28, 1992

[54] MUSICAL BALLOON

[76] Inventor: Richard S. Margolis, 932 Thompson Blvd., Buffalo Grove, Ill. 60090

[21] Appl. No.: 552,943

[22] Filed: Jul. 16, 1990

[51] Int. Cl.[5] ..... A63H 3/06

[52] U.S. Cl. ..... 446/220; 446/222; 446/226

[58] Field of Search ..... 446/220, 221, 222, 223, 446/224, 225, 226, 404, 408, 484, 901, 485, 397

[56] References Cited

U.S. PATENT DOCUMENTS

| | | | |
|---|---|---|---|
| 2,763,958 | 9/1956 | Lemelson | 446/225 |
| 3,026,648 | 3/1962 | Lemelson | 446/226 |
| 3,073,058 | 2/1963 | Lemelson | 446/220 |
| 4,704,934 | 10/1987 | Nosrati | 446/200 |

FOREIGN PATENT DOCUMENTS

| | | | |
|---|---|---|---|
| 854768 | 11/1952 | Fed. Rep. of Germany | 446/220 |

*Primary Examiner*—Robert A. Hafer
*Assistant Examiner*—David J. Kenealy

[57] ABSTRACT

A musical balloon having an electronic music-producing device including a speaker, an integrated circuit tone modulator, a battery and switch means for activating it affixed to the exterior wall of said inflatable balloon by means of a patch of material that overlies the electronic music-producing device so as to conceal it and is sufficiently flexible to permit the switch means to be activated by pressing on the patch of material, whereby the electronic music-producing device can be activated when desired.

9 Claims, 2 Drawing Sheets

MUSICAL BALLOON

This invention relates to an inflatable balloon. More particularly, it relates to an inflatable balloon having affixed thereto an electronic music-producing device for playing a tune.

Inflatable balloons having electronic music-producing devices are known in the prior art. Some of these balloons have the electronic music-producing device contained within the interior of the balloon. Others have the electronic music-producing device contained within the stem of the balloon. Balloons of these types have not been entirely acceptable to the trade for a variety of different reasons. In particular, the fact that the music-producing device is contained within the interior of the balloon makes it difficult to secure the device so that it does not freely float around inside of the balloon. In such cases, the balloons are punctured by the device and hence destroyed. If the device is contained within the stem of the balloon, it is generally difficult to secure the stem to prevent the balloon from deflating. Special means are needed to secure the stem to prevent the leakage. Also, the electronic music-producing devices generally include a mechanical switch which must be activated before music is produced so that the device does not continuously play music. When the music-producing device is contained within the balloon or the stem of the balloon it is difficult to operate the mechanical switch. Accordingly, the trade is continually seeking an improved musical balloon.

It is therefore an object of the present invention to provide an improved musical balloon.

Another object is to provide an improved musical balloon having the electronic music-producing device secured to the exterior of the balloon.

Still another object is to provide an easy and efficient method of attaching the electronic music-producing device to the balloon. In this respect, the electronic music-producing device can be affixed to virtually any inflatable balloon made of, for example, rubber, rubber-like latex and mylar materials.

Another object is to provide a musical balloon which can be easily affixed to another object such as, for example, clothing, a present or greeting card.

The above objectives as well as others not specifically mentioned are accomplished with the musical balloon of the present invention which has an electronic music-producing device affixed to it. The balloon is inflated, and the electronic music-producing device then is affixed to the balloon by adhering it to the balloon with a patch of material which may have an adhesive material on one side, or both, of it. The patch of material may have a hole pre-formed in it to expose a portion of the mechanical switch so that it can be easily activated. Alternatively, a marker can be printed on the patch of material to indicate where the mechanical switch is located so that it can be activated. A rigid backing preferably is affixed to the device to provide sufficient resistance against the balloon so that the mechanical switch can be more easily operated.

In accordance with a second embodiment of the invention, the electronic music-producing device is prepackaged within a pouch. In this case also it is preferred to affix the electronic music-producing device to a backing before it is inserted in the pouch. The pouch has an adhesive applied to at least one side of it so that the pouch containing the music-producing device can be easily and quickly affixed to the balloon.

The adhesive on both sides of the patch of material, or pouch, permits the music-producing device to be affixed to the balloon, and the balloon then affixed to a present, a greeting card or, for example, to the lapel of a person's coat.

These objects, advantages and features of the invention will be apparent from the following description when considered in conjunction with the accompanying drawings wherein.

Figure 1:
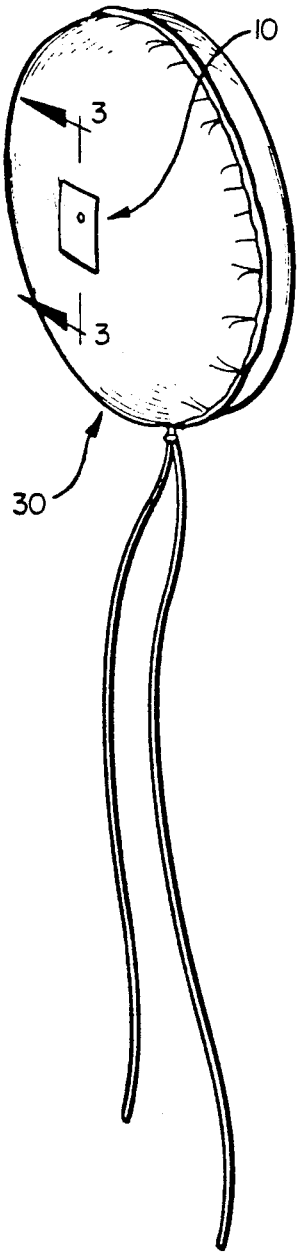
FIG. 1 is a perspective view of a balloon having a music-producing device affixed thereto in accordance with the invention.
Figure 2:
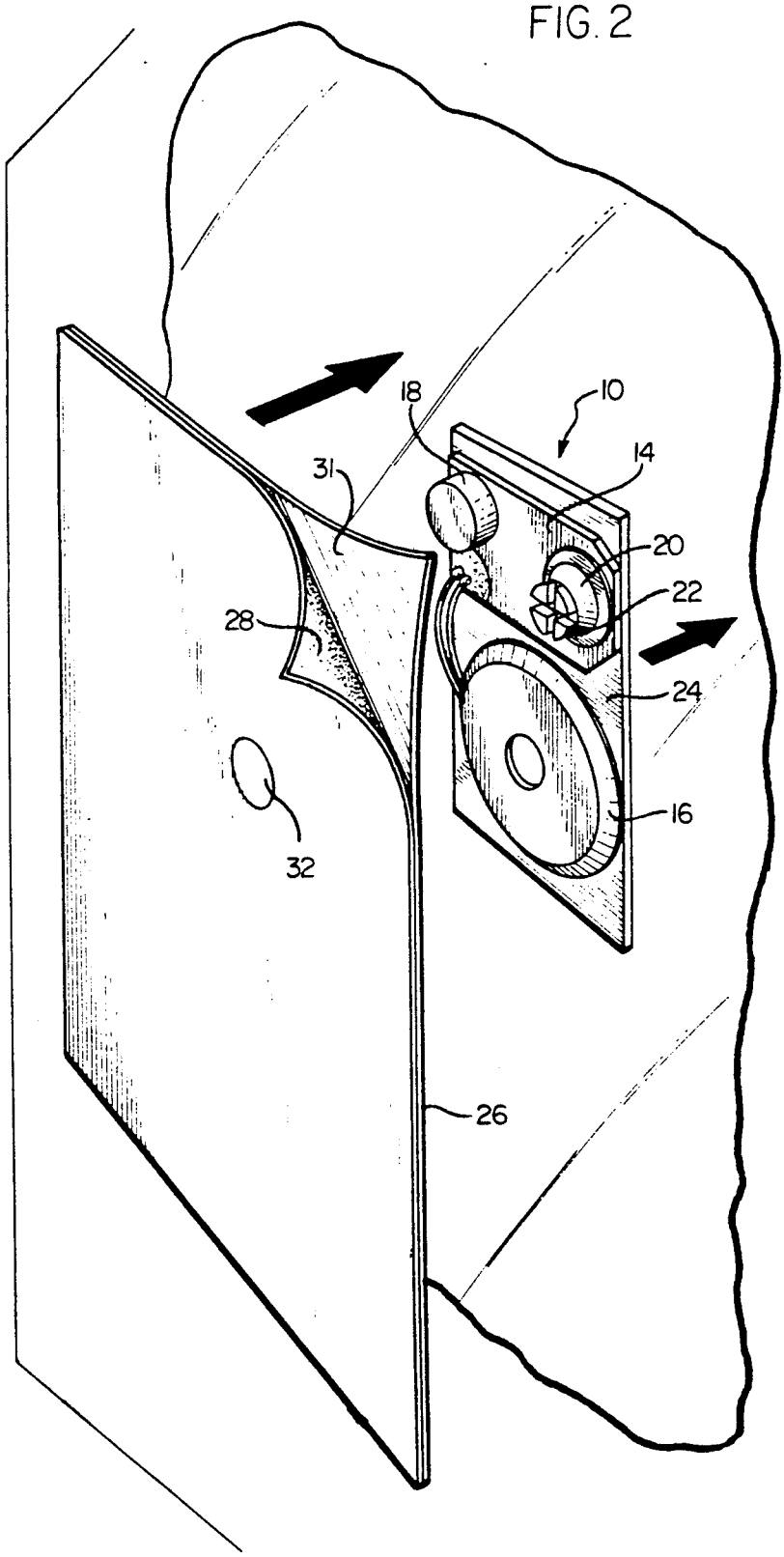
FIG. 2 is a partial perspective view illustrating the manner in which the music-producing device is affixed to the balloon in accordance with one embodiment of the invention.

Referring now to the drawing, in FIG. 1 there is illustrated a balloon 30 having an electronic music-producing device 10 affixed to it in accordance with the invention. The device 10, as can be best seen in FIG. 2 includes an integrated circuit in the form of a small chip 14 that is programmed to modulate tones produced by a speaker 16. The tone produced by the chip 14 can be any one of a number of tones, such as "Happy Birthday," "The Wedding Song," and the like. The chip 14 is powered by a battery 18. A mechanical switch 20 which is operated by pushing a button 22 activates the music-producing device 10. The music-producing device 10 may be any one of several available, such as the type produced by Chiki Industrial Ltd. of Hong Kong. The circuit board 12 preferably and advantageously is affixed to a relatively rigid backing 24 such as paperboard or the like for reasons explained more fully below.

Figure 3:
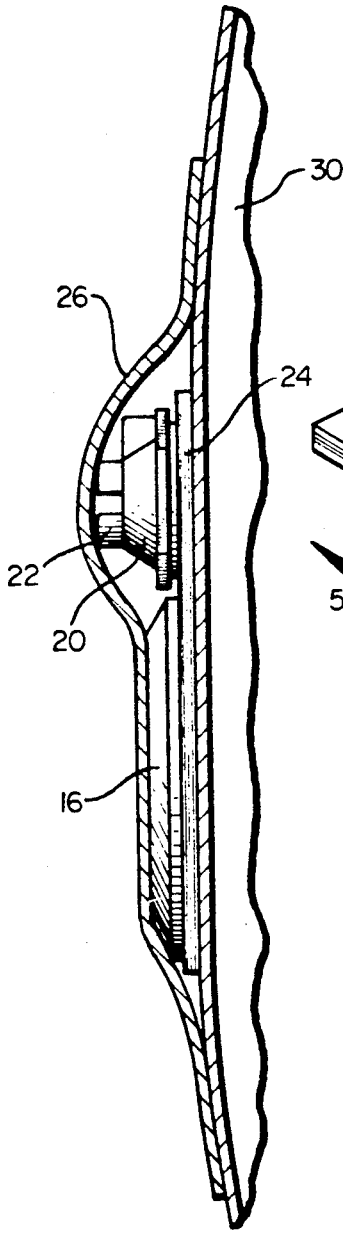
FIG. 3 is a sectional view taken along lines 3—3 of FIG. 1.

A patch of material 26 larger in size than the size of the backing 24 and having an adhesive 28 on at least one side thereof is provided for adhering the music-producing device 10 to the balloon 30, as can be seen in FIG. 3. The patch of material preferably is of the same color and material as the balloon 30 to which it is affixed so that it blends in with the balloon once it is affixed to the balloon. The patch of material 26 also may have a peel-off backing 31 covering the adhesive 28. A hole 32 of a size to receive therethrough the button 22 of the mechanical switch 20 is provided in the patch of material 26. Alternatively, a marker 32 can be provided on the patch of material 26 to provide an indication as to where the switch 20 is located.

In affixing the music-producing device 10 to the balloon 30, the peel-off backing 31 is removed from the patch of material 26 to expose the adhesive 28. The music-producing device 10 then is adhered to the patch of material 26 with the button 22 extending through the hole 32, or beneath the marker on the patch. The patch of material 26 with the music-producing device 10 affixed to it is adhesively affixed to the exterior of the wall of the balloon 30, as illustrated in FIG. 3.

When it is desired to activate the music-producing device 10, the button 22 is pressed. The rigid backing 24 affixed to the device 10 provides sufficient resistance against the balloon 30 such that the button 22 can be easily pressed to activate the music-producing device 10, and also functions to protect it from bending or breakage.

Figure 4:
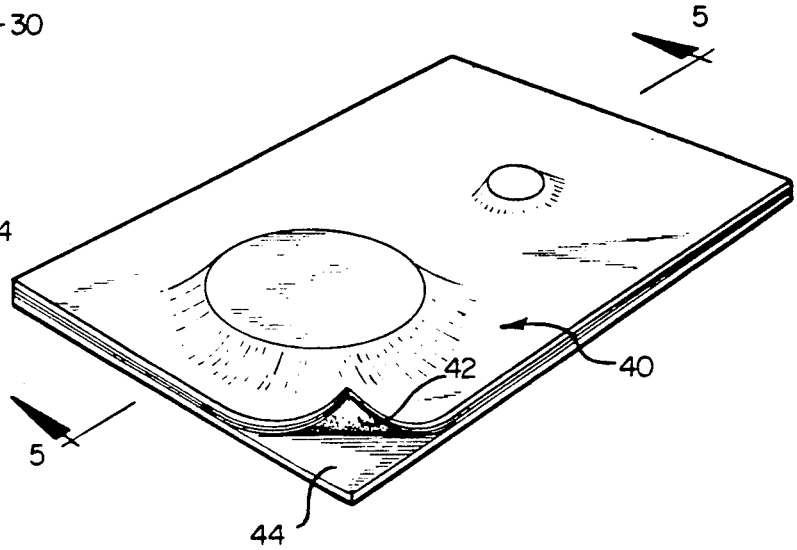
FIG. 4 is a perspective view illustrating the pouch used to affix the music-producing device to a balloon.
Figure 5:
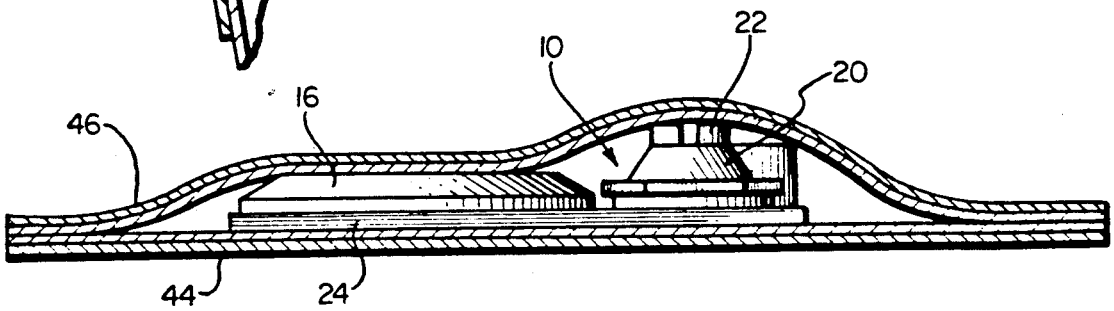
FIG. 5 is a sectional view taken along lines 5—5 of FIG. 4.

In FIGS. 4 and 5 there is illustrated a pouch 40 which is proportioned to receive therein the music-producing device 10. The pouch 40 likewise is of the same color and material as the balloon to which the music-producing device 10 is to be affixed. The pouch 40 has an adhesive 42 affixed to at least one of its sides, and the adhesive 42 is covered with a peel-off backing 44.

In affixing the music-producing device 10 to a balloon, it is inserted into the pouch 40 and the pouch 40 is sealed by, for example, heat sealing it. The peel-off back 44 then is removed and the pouch 40 is adhesively affixed to the balloon.

As illustrated in FIG. 5, adhesive and a peel-off back 46 also can be affixed to the other side of the pouch 40. An adhesive and peel-off back also can be affixed to the other side of the patch of material 26. In either case, once the music-producing device 10 is affixed to a balloon, the peel-off back 46 can be removed and the balloon with the music-producing device 10 attached can be adhesively attached to another object. For example, the balloon can be attached to the label of a person's coat or to any article of clothing. It also can be adhesively affixed to a birthday present, in which case, the music-producing device 10 can play "Happy Birthday." The balloon also can be affixed to a birthday card.

What is claimed is:

1. A musical balloon comprising:

an inflatable balloon;

an electronic music-producing device including a speaker, an integrated circuit tone modulator, a battery and switch means for activating said device, said electronic music-producing device being affixed tot he exterior wall of said inflatable balloon by means of a patch of material, said patch of material overlying said electronic music-producing device so as to conceal it and being sufficiently flexible to permit said switch means to be activated by pressing on said patch of material, whereby said electronic music-producing device can be activated when desired.

2. The musical balloon of claim 1, wherein said electronic music-producing device is affixed to said inflatable balloon after the latter is inflated.

3. The musical balloon of claim 1, wherein said patch of material is of a like kind as the material forming said inflatable balloon.

4. The musical balloon of claim 1, further comprising a peel-off material covering said adhesive on said patch of material, said peel-off material being removed to expose said adhesive.

5. The musical balloon of claim 4, further comprising adhesive affixed to the other side of said patch of material, whereby said musical balloon can be adhesively affixed to another object.

6. The musical balloon of claim 5, further comprising a second peel-off material covering said adhesive on said other side of said patch of material.

7. The musical balloon of claim 1, wherein said electronic music-producing device is affixed to the exterior wall of said inflatable balloon by means of a pouch proportioned to receive therein said electronic music-producing device, said pouch having adhesive affixed to at least one side thereof for adhesively affixing said pouch with said electronic music-producing device disposed therein to the exterior wall of said inflatable balloon.

8. The musical balloon of claim 7, further comprising a peel-off material covering said adhesive on said pouch, said peel-off material being removed to expose said adhesive.

9. The musical balloon of claim 7, further comprising adhesive affixed to both sides of said pouch, and a peel-off material covering said adhesive on both sides of said pouch.

* * * * *